US007771239B1

(12) United States Patent
Hsiao

(10) Patent No.: US 7,771,239 B1
(45) Date of Patent: Aug. 10, 2010

(54) POWER RECEPTACLE DEVICE WITH ROTATABLE SOCKETS

(75) Inventor: Feng-Shen Hsiao, Taipei (TW)

(73) Assignee: Rite-Tech Industrial Co., Ltd., Taipei (TW)

( * ) Notice: Subject to any disclaimer, the term of this patent is extended or adjusted under 35 U.S.C. 154(b) by 0 days.

(21) Appl. No.: 12/496,266

(22) Filed: Jul. 1, 2009

(51) Int. Cl.
*H01R 25/00* (2006.01)

(52) U.S. Cl. ..... 439/640

(58) Field of Classification Search ..... 439/640, 439/652, 133, 135, 367
See application file for complete search history.

(56) References Cited

U.S. PATENT DOCUMENTS 6,991,467 B1 * 1/2006 Cheng et al. ..... 439/10
7,264,514 B2 * 9/2007 Hsu et al. ..... 439/640
7,374,425 B1 * 5/2008 Kuo et al. ..... 439/31
7,473,141 B2 * 1/2009 Liao ..... 439/638
7,553,174 B2 * 6/2009 Roepke et al. ..... 439/136
7,556,535 B2 * 7/2009 Liao ..... 439/640
2003/0186581 A1 * 10/2003 Hsiao ..... 439/501

* cited by examiner

*Primary Examiner*—Chandrika Prasad
(74) *Attorney, Agent, or Firm*—Muncy, Geissler, Olds & Lowe, PLLC

(57) ABSTRACT

A power receptacle device has a stationary base and at least one rotating base. The at least one rotating base is mounted rotatably in the stationary base and has at least one socket. The at least one socket is covered when the rotating base is rotated to a position to prevent users from touching the at least one socket and getting electric shock. Further, because the at least one rotating base is rotatable, the at least one socket on the at least one rotating base is exposed and accessible when the at least one rotating base is turned out from the at least one rotating base.

15 Claims, 13 Drawing Sheets

POWER RECEPTACLE DEVICE WITH ROTATABLE SOCKETS

BACKGROUND OF THE INVENTION

1. Field of the Invention

The present invention relates to a power receptacle device, and more particularly to a power receptacle device with rotatable sockets.

2. Description of Related Art

Electric devices and appliances are being used increasingly in the home, at work and during travel and require an individual source of power for use or charging so are plugged into sockets in electrical outlets. However, additional electrical outlets and sockets are expensive to install and may only be used temporarily, so power strips are used for quick and simple extension or expansion of outlets and sockets. A conventional power strip has a base and a power cable. The base has multiple sockets to allow electric devices to plug in. The power cable electrically connects the multiple sockets to an external power source.

However, if the sockets on the base are arranged closely together, a power cable of one electric device having a plug with a large power adapter, especially one with a transformer or rectifier, may cover up an adjacent socket. Therefore, a number of available sockets is reduced. Furthermore, when not in use a power strip is not attractive so is usually hidden behind furniture, but then is inaccessible for frequent use items, such as portable music players, cell phones, PDAs and the like.

When traveling with multiple devices such as a laptop, camera, cell phone, PDA, speakers, external drive, printer, portable music player and the like, an adapter, converter or both may also be required to allow a plug be inserted to the socket and ensure a correct voltage, alternatively only one socket may be provided per room, therefore, small portable power strips are required. However, minimizing a size of power strip increases power cables blocking adjacent sockets and providing sockets on multiple faces may increase a risk or fire or electric shock should a socket be on the ground and liquid be spilled or accumulate nearby.

To overcome the shortcomings, the present invention provides a power receptacle device having rotatable sockets to mitigate or obviate the aforementioned problems.

SUMMARY OF THE INVENTION

An objective of the invention is to provide a power receptacle device having at least one rotatable socket. The power receptacle device in accordance with the present invention comprises a stationary base and at least one rotating base. The rotating base is rotatably mounted in the stationary base and has at least one socket. The at least one socket is covered when the rotating base is rotated to be received in the stationary base and is exposed to be accessible when the rotating base is turned out from the stationary base.

Another objective of the present invention is to provide a power receptacle device having rotatable sockets. The power receptacle device comprises a stationary base and multiple rotating bases. The rotating bases are rotatably mounted in the stationary base and each has at least one socket. The sockets of the rotating bases are covered by other rotating bases when the rotating bases are rotated to a position and are exposed for use when the rotating bases are staggered.

Other objectives, advantages and novel features of the invention will become more apparent from the following detailed description when taken in conjunction with the accompanying drawings.

BRIEF DESCRIPTION OF THE DRAWINGS

FIG. 3 is a perspective view of the power receptacle device in FIG. 1 showing the rotating base being turned out from;

DETAILED DESCRIPTION OF PREFERRED EMBODIMENT

Figure 1:
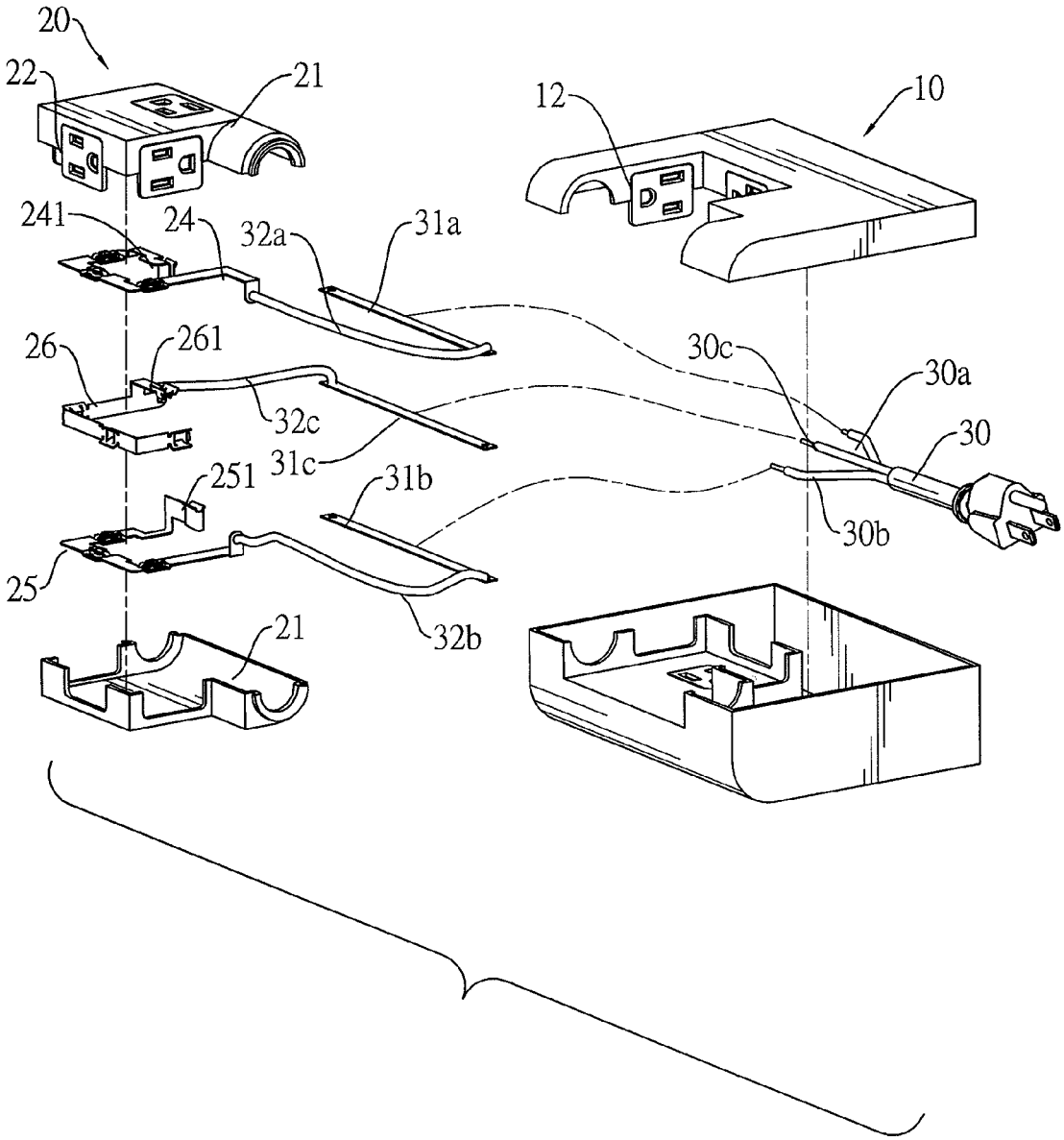
FIG. 1 is a perspectively exploded view of a first embodiment of a power receptacle device in accordance with the present invention.
Figure 2:
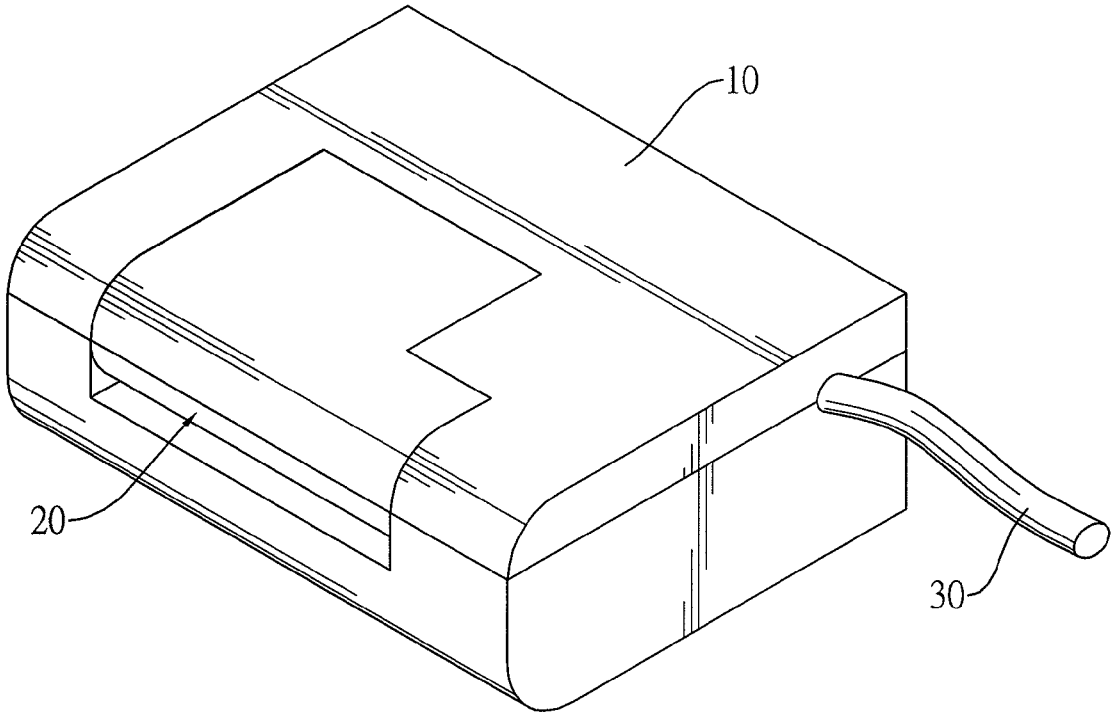
FIG. 2 is a perspective view of the power receptacle device in FIG. 1, showing a rotating base in a hollow of a stationary base of the power strip.
Figure 3:
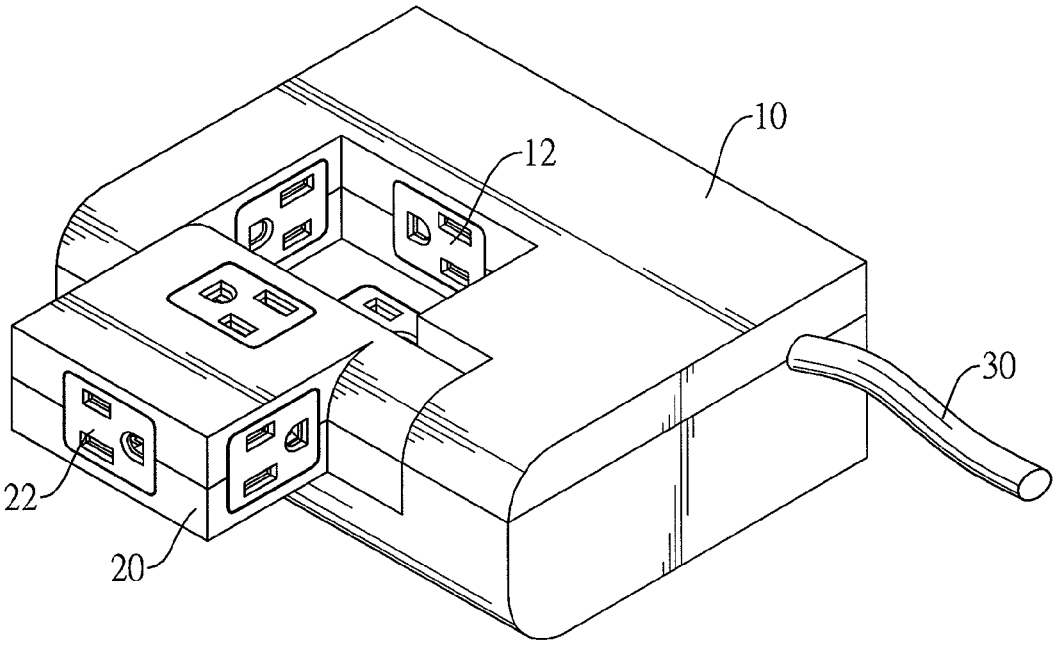

With reference to FIGS. 1 to 3, a first embodiment of a power receptacle device in accordance with the present invention is implemented as a power strip and comprises a stationary base (10) and a rotating base (20).

The stationary base (10) has one or more sockets (12) and has an electricity connection assembly. The electricity connection assembly can be implemented as a power cable (30) with three cords (30*a*)(30*b*)(30*c*) for transmitting electricity as shown in FIGS. 1 to 12 or implemented as a power plug composed of three contact prongs (40*a*)(40*b*)(40*c*) as shown in FIG. 13. The rotating base (20) is mounted rotatably in the stationary base (10) and has one or more sockets (22). All the sockets (12)(22) in the stationary base (10) and the rotating base (20) are turned toward each other respectively when the rotating base (20) is rotated to a proper position so that the sockets (12)(22) are covered by the rotating base (20). In this embodiment, all the sockets (12)(22) are turned toward each other when the rotating base (20) is in a rest status without being rotated as shown in FIG. 2. As the rotating base (20) is turned out from the stationary base (10), the sockets (12)(22) in the stationary base (10) and the rotating base (20) are exposed.

The sockets (22) of the rotating base (20) can be electrically connected to the power cable (30) via different techniques. FIG. 1 shows an embodiment of the electric connection between the sockets (22) and the power cable (30). The electric connection is implemented by connecting multiple blades (24)(25)(26), named a live blade (24), a neutral blade (25) and a ground blade (26) hereinafter, in the rotating base (20) to multiple conductive plates (31*a*)(31*b*)(31*c*) held in the stationary base (10) through wires (32*a*)(32*b*)(32*c*) respectively, and the conductive plates (31*a*)(31*b*)(31*c*) are electrically connected to the power cable (30).

In the rotating base (20), each blade (24)(25)(26) is substantially U-shaped and is formed integrally with multiple contacts (241)(251)(261). Each socket (22) on the rotating base (20) corresponds to three different contacts (241)(251)(261) of the blades (24)(25)(26).

To achieve relative rotation between the stationary base (10) and the rotating base (20), the rotating base (20) provides a hollow barrel (21) to pivotally connected to through holes formed on the stationary base (10). The hollow barrel (21) allows the wires (32*a*)(32*b*)(32*c*) to extend into the stationary base (10) from the rotating base (20) and connect to the conductive plates (31*a*)(31*b*)(31*c*) respectively.

Figure 4:
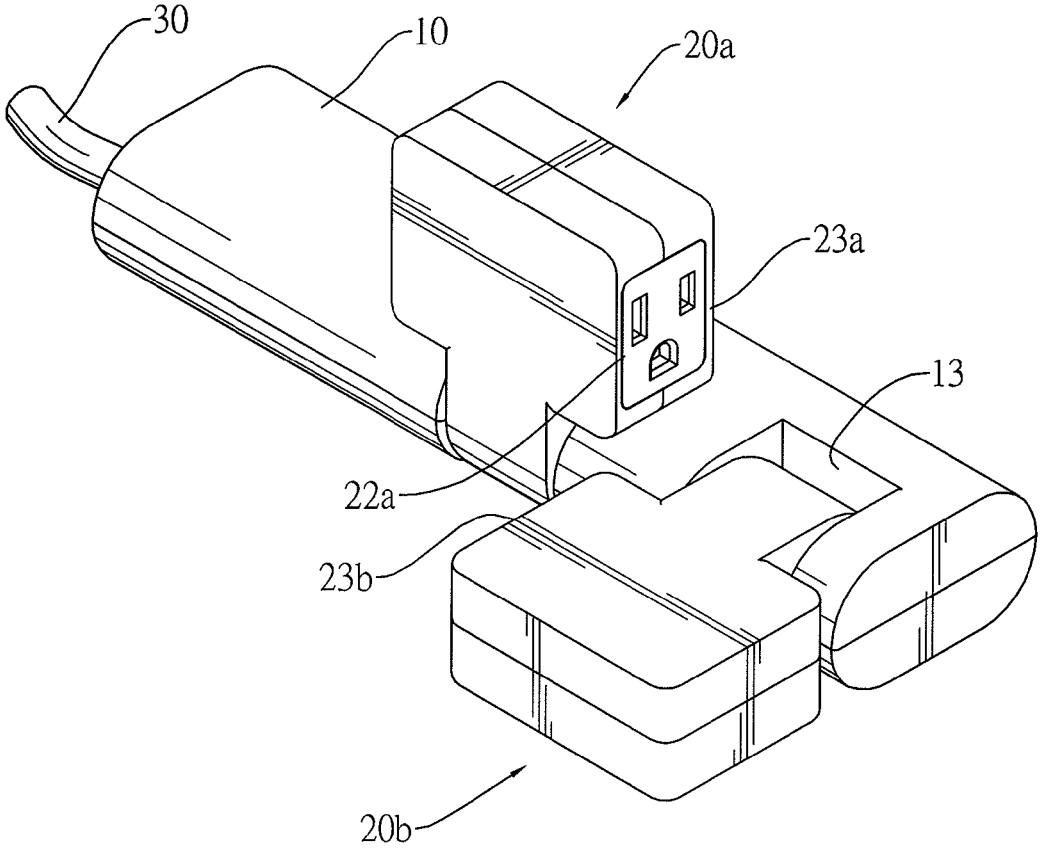
FIG. 4 is a perspective view of a second embodiment of a power receptacle device in accordance with the present invention.
Figure 5:
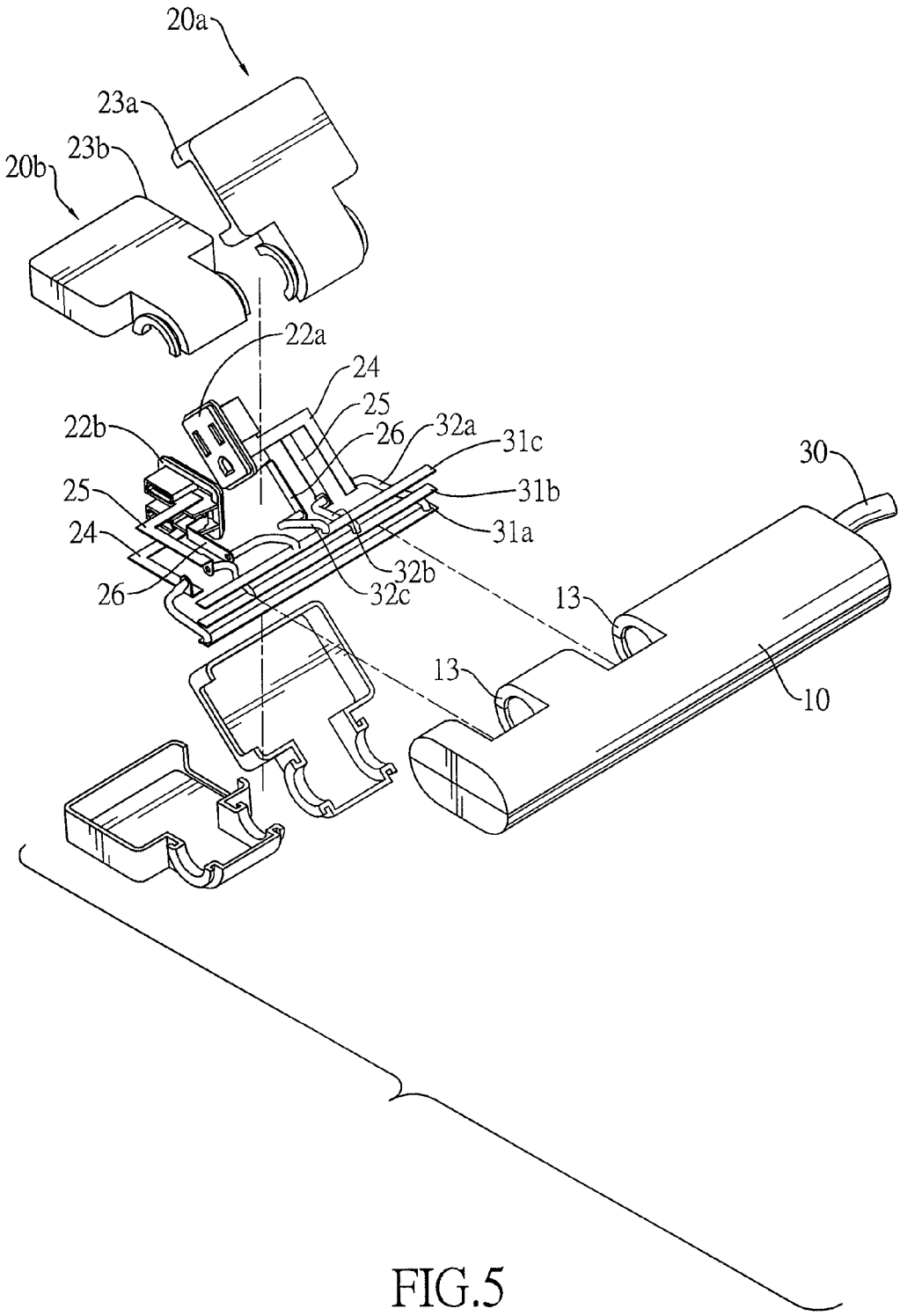
FIG. 5 is an exploded view of the power receptacle device in FIG. 4.

With reference to FIGS. 4 and 5, a second embodiment of a power receptacle device in accordance with the present invention is implemented as a power strip and comprises a stationary base (10) and two rotating bases (20*a*)(20*b*). The stationary base (10) has two notches (13) formed at the same side, and the two rotating bases (20*a*)(20*b*) are mounted rotatably and respectively in the notches (13). The stationary base (10) also has a power cable (30). Each of the rotating bases (20*a*)(20*b*) has an adjacent surface (23*a*)(23*b*) and a socket (22*a*)(22*b*) formed on the adjacent surface (23*a*)(23*b*) and electrically connected to the power cable (30).

The sockets (22*a*)(22*b*) are covered by the rotating bases (20*a*)(20*b*) when the two rotating bases (20*a*)(20*b*) are turned to a position where the adjacent surfaces (23*a*)(23*b*) of the two rotating bases (20*a*)(20*b*) face each other. In this embodiment, as long as the two rotating bases (20*a*)(20*b*) turn in the same direction with the same angle, the sockets (22*a*)(22*b*) face each other. As the rotating bases (20*a*)(20*b*) are staggered, the sockets (22*a*)(22*b*) in the rotating bases (20*a*)(20*b*) are exposed. The electric connection between the power cable (30) and each rotating base (20*a*)(20*b*) is similar to the first embodiment. Each socket (22*a*)(22*b*) has three blades (24)(25)(26) being connected to the conductive plates (31*a*)(31*b*)(31*c*) held in the stationary base (10) through wires (32*a*)(32*b*)(32*c*) respectively.

Figure 6:
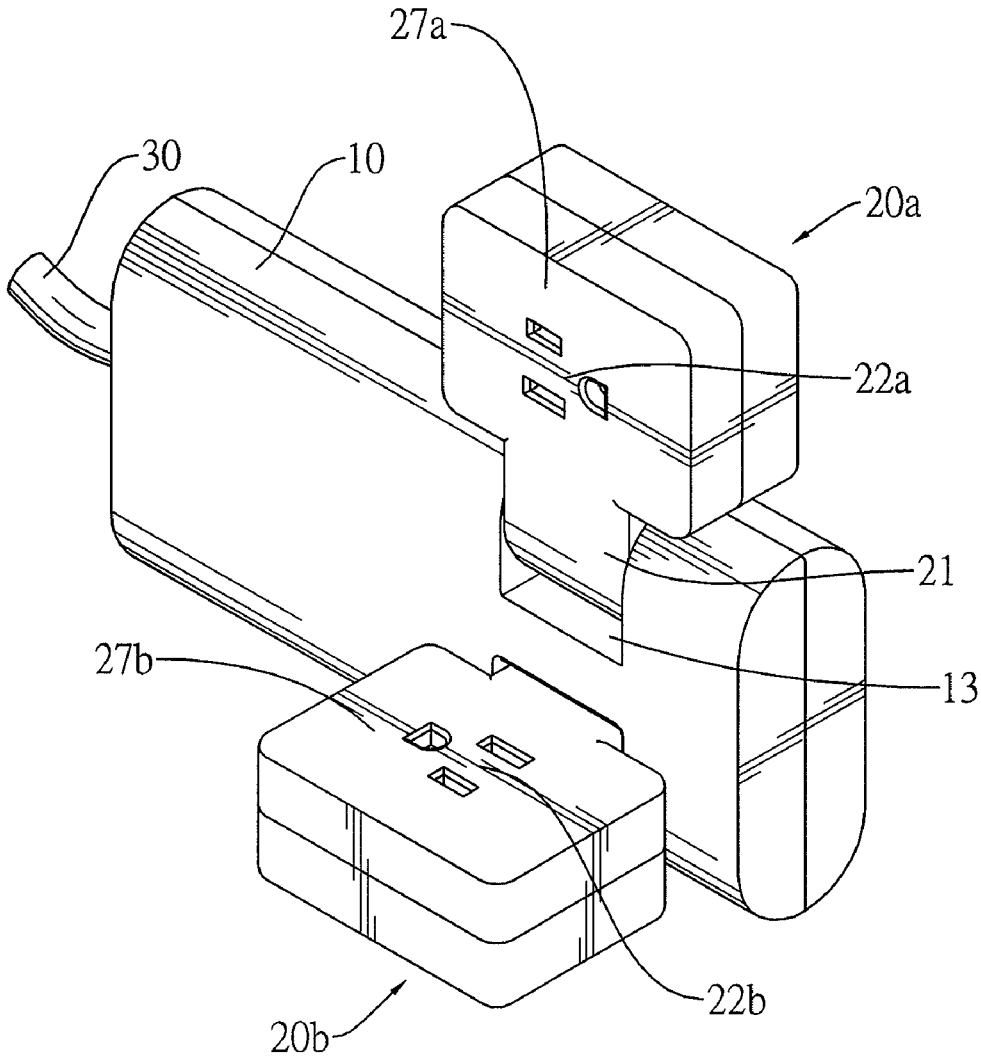
FIG. 6 is a perspective view of a third embodiment of a power receptacle device in accordance with the present invention.
Figure 7:
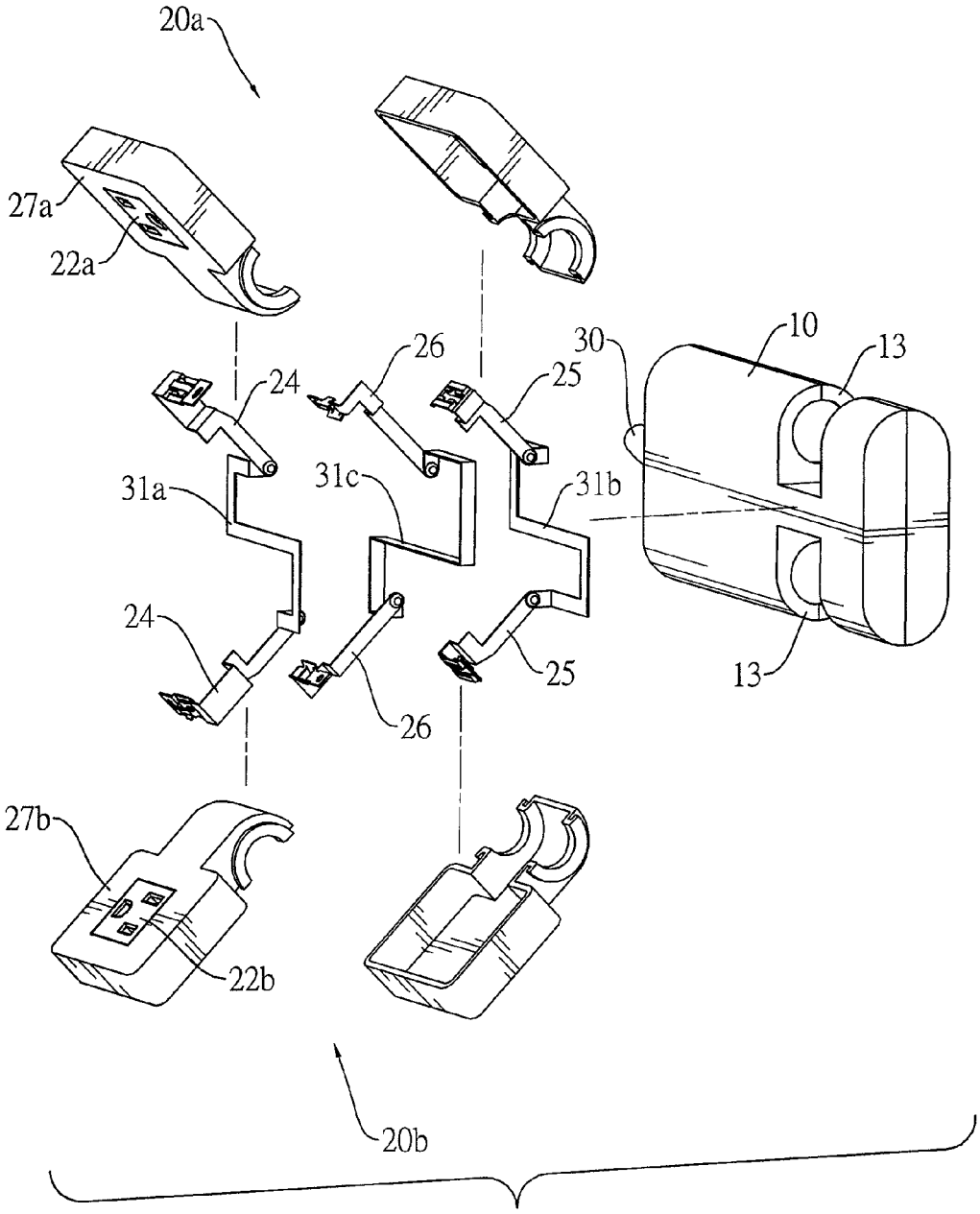
FIG. 7 is an exploded view of the power receptacle device in FIG. 6.

With reference to FIGS. 6 and 7, a third embodiment of a power strip in accordance with the present invention comprises a stationary base (10) and two rotating bases (20*a*)(20*b*). The stationary base (10) has two opposite edges and two notches (13) formed in the opposite edges. The two rotating bases (20*a*)(20*b*) are mounted rotatably and respectively in the notches (13). The stationary base (10) also has a power cable (30). Each of the rotating bases (20*a*)(20*b*) has an overlap surface (27*a*)(27*b*) and a socket (22*a*)(22*b*) formed and on the overlap surface (27*a*)(27*b*) and electrically connected to the power cable (30). The sockets (22*a*)(22*b*) on the two overlap surfaces (27*a*)(27*b*) are covered by the rotating bases (20*a*)(20*b*) when the rotating bases (20*a*)(20*b*) are turned to overlap each other. As the rotating bases (20*a*)(20*b*) rotates outward, the sockets (22*a*)(22*b*) in the rotating bases (20*a*)(20*b*) are exposed. The electric connection between the power cable (30) and each rotating bases (20*a*)(20*b*) may be accomplished by connecting the blades (24)(25)(26) of each socket (22*a*)(22*b*) to the conductive plates (31*a*)(31*b*)(31*c*) held in the stationary base (10) using wires as described above. Alternately, the electric connection can be implemented by directly connecting the conductive plates (31*a*)(31*b*)(31*c*) to the blades (24)(25)(26). The conductive plates (31*a*)(31*b*)(31*c*) are mounted immovably in the stationary base (10) and electrically connected to the power cable (30). Further, the plates (31*a*)(31*b*)(31*c*) are connected pivotally to the blades (24)(25)(26) of each socket (22*a*)(22*b*) of each rotating base (20*a*)(20*b*). Therefore, each rotating base (20*a*)(22*b*) still can accomplish rotating movement relative to the stationary base (10).

Figure 8:
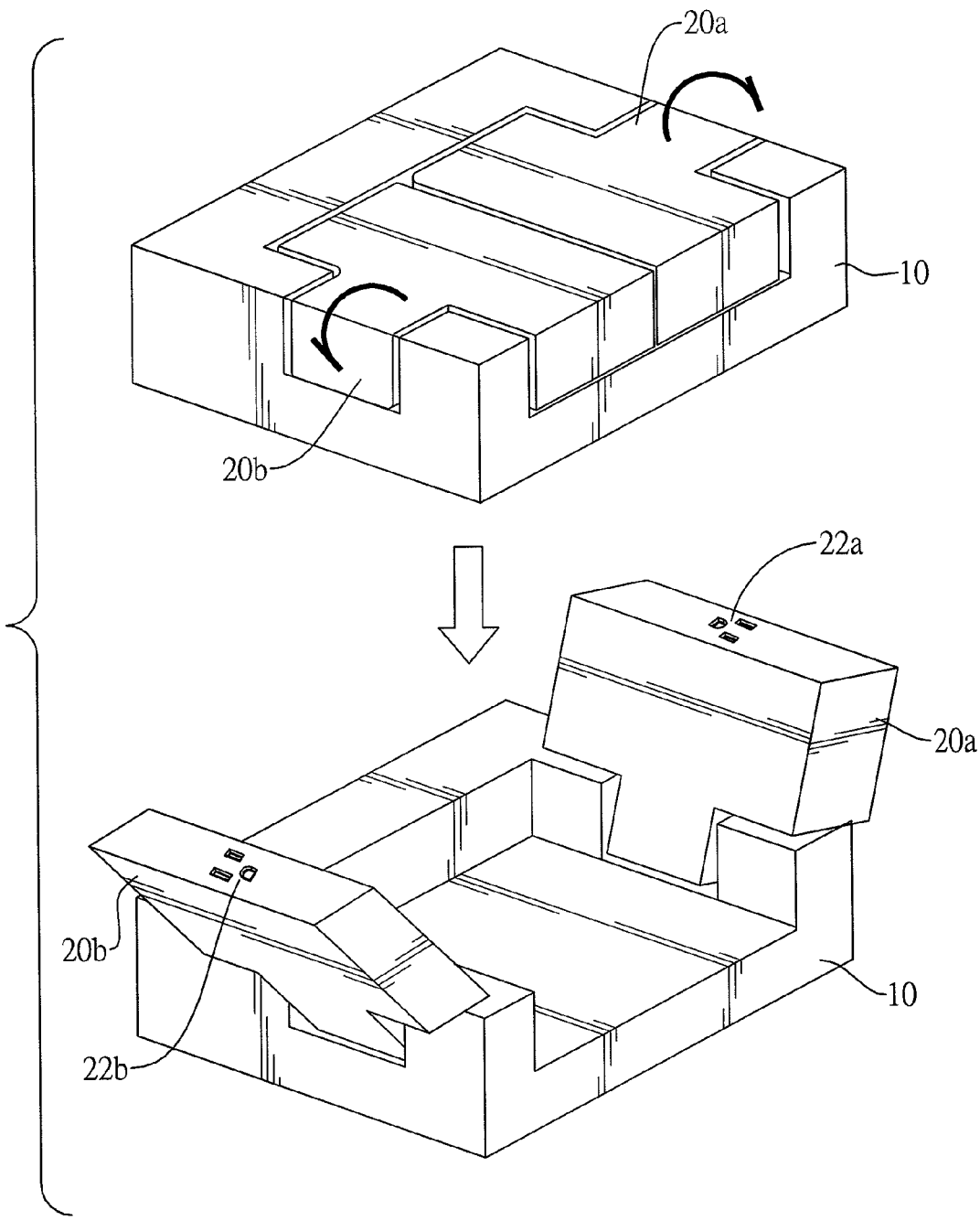
FIG. 8 is an operational view of a fourth embodiment of a power receptacle device in accordance with the present invention.
Figure 9:
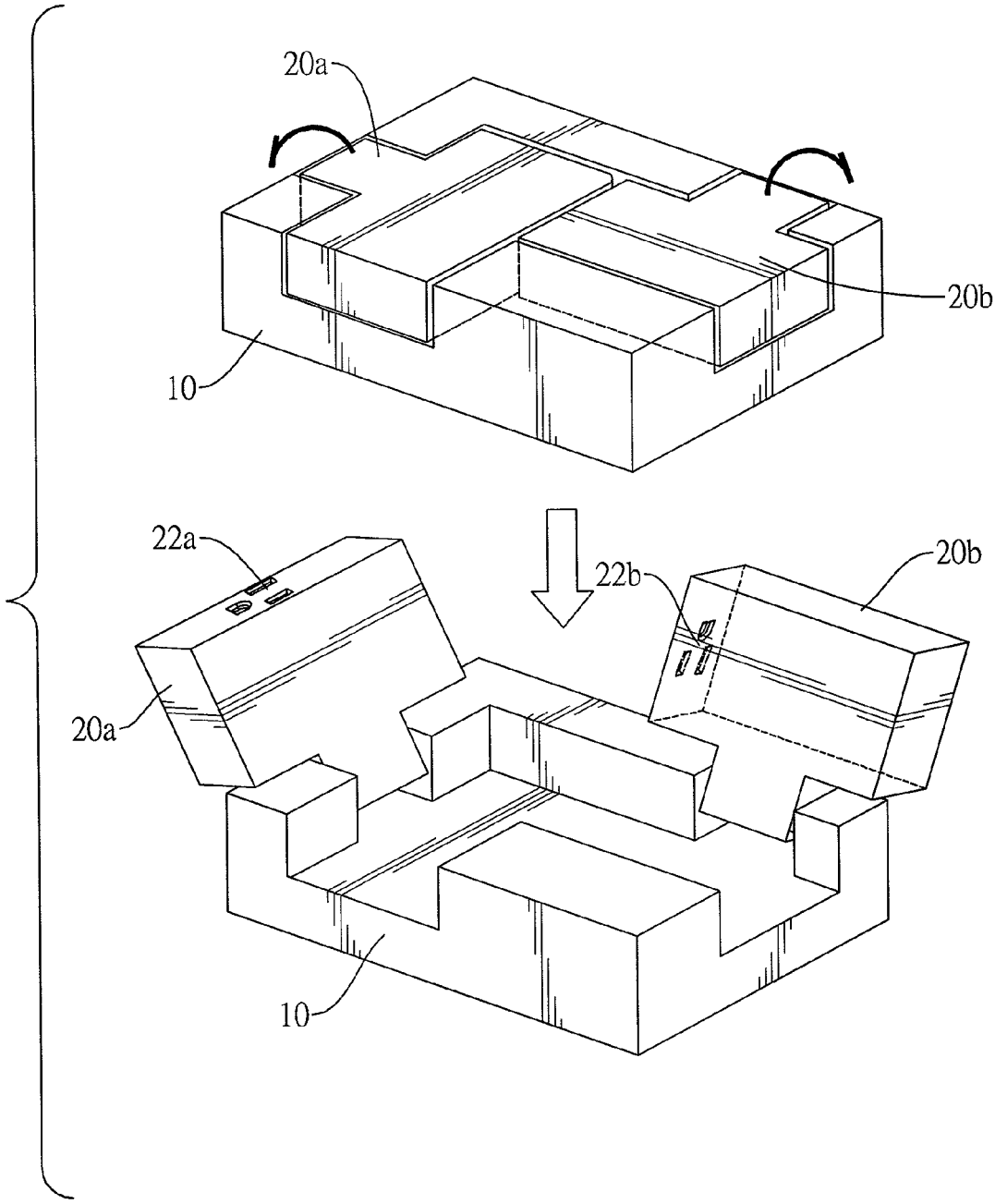
FIG. 9 is an operational view of a fifth embodiment of a power receptacle device in accordance with the present invention.

With reference to FIG. 8, the rotating bases (20*a*)(20*b*) are rectangular and mounted rotatably in opposite sides of the stationary base (10). When the rotating bases (20*a*)(20*b*) are received in the stationary base (10) and turned to a closed position, the sockets (22*a*)(22*b*) formed on the rotating bases (20*a*)(20*b*) face each other. With reference to FIG. 9, the rotating bases (20*a*)(20*b*) are rectangular and mounted rotatably in adjacent sides of the stationary base (10). When the rotating bases (20*a*)(20*b*) are received in the stationary base (10) and turned to a closed position, the socket (22*a*) of one rotating bases (20*a*) faces to the socket (22*b*) of the other rotating base (20*b*). Since each rotating base (20*a*)(20*b*) is rotatable, the sockets (22*a*)(22*b*) can be exposed when the rotating bases (20*a*)(20*b*) are turned out.

Figure 10:
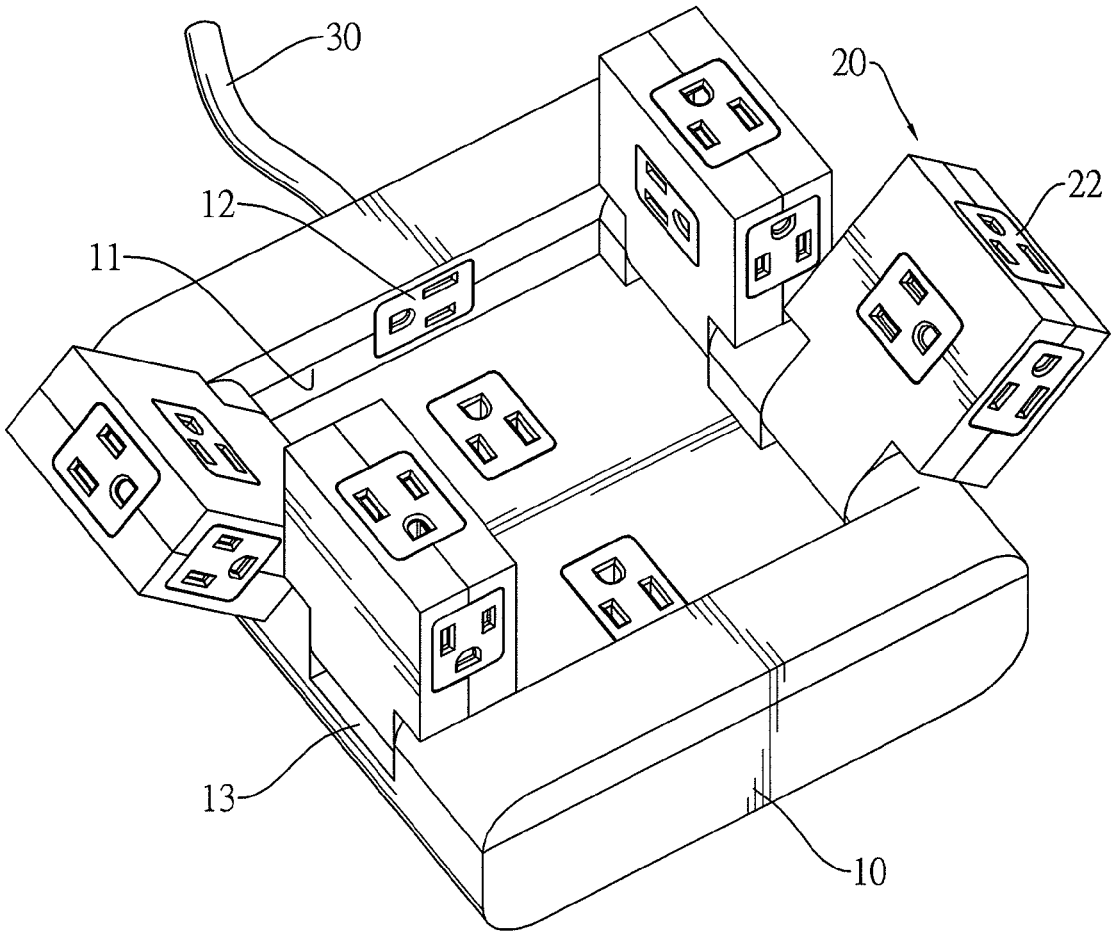
FIG. 10 is a perspective view of a sixth embodiment of a power receptacle device in accordance with the present invention.
Figure 11:
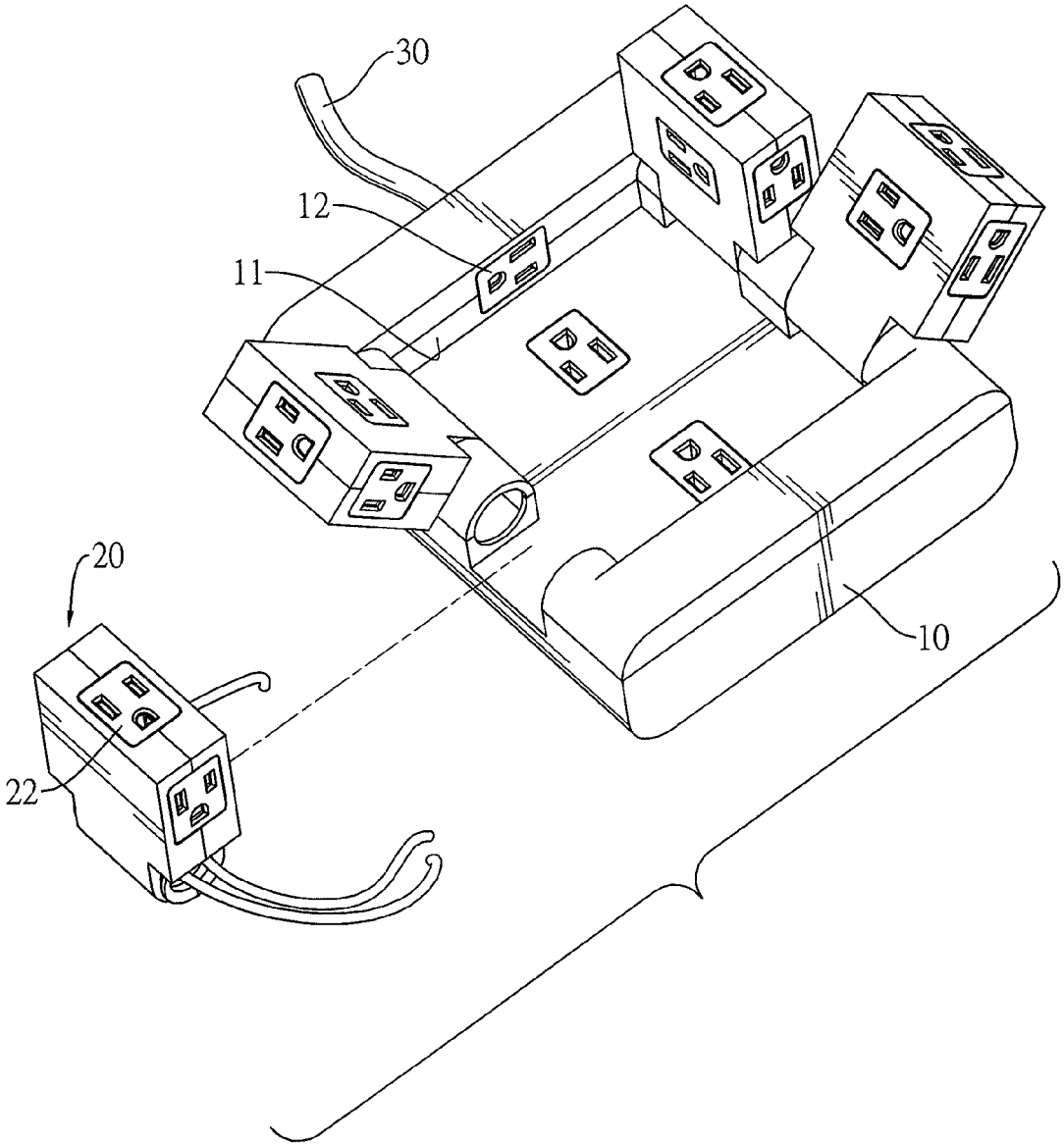
FIG. 11 is a perspectively exploded view of the power receptacle device in FIG. 10.
Figure 12:
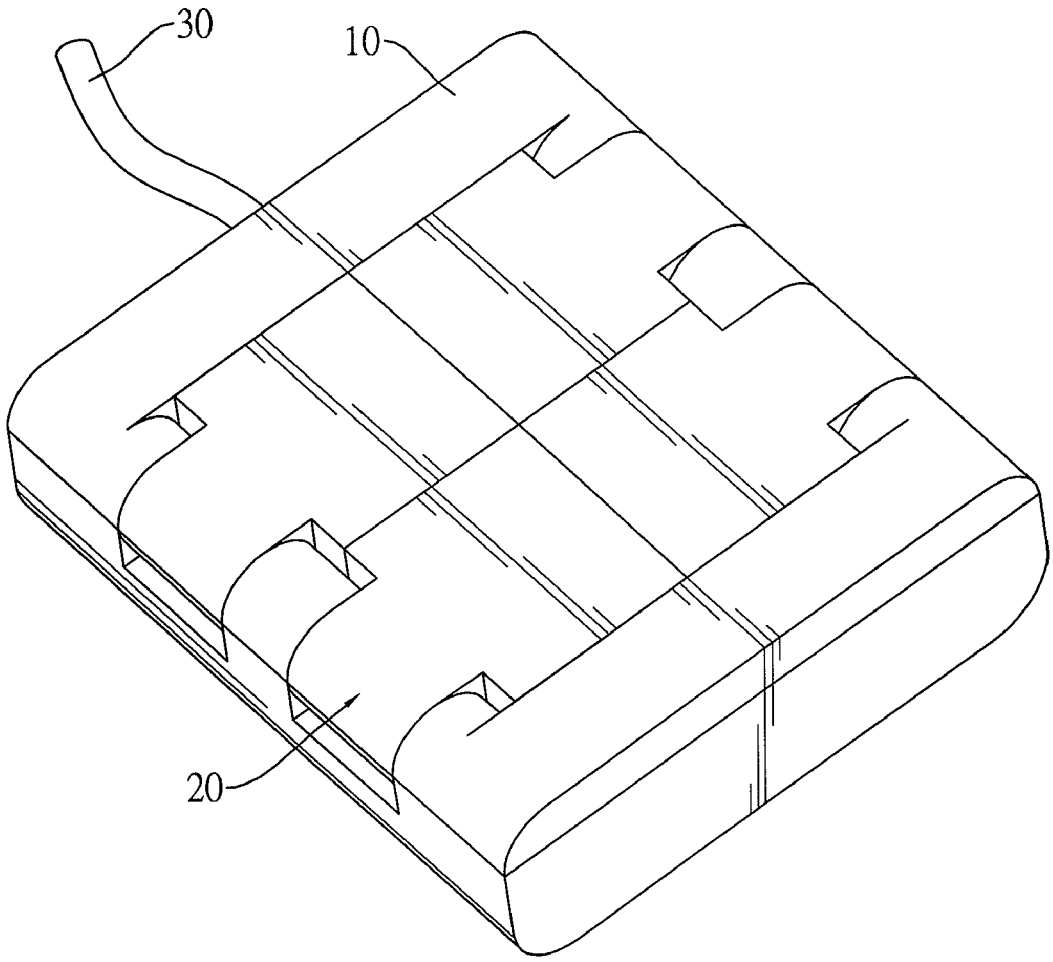
FIG. 12 is a perspective view of the power strip in FIG. 10, showing multiple rotating bases in a hollow of a stationary base of the power receptacle device.
Figure 13:
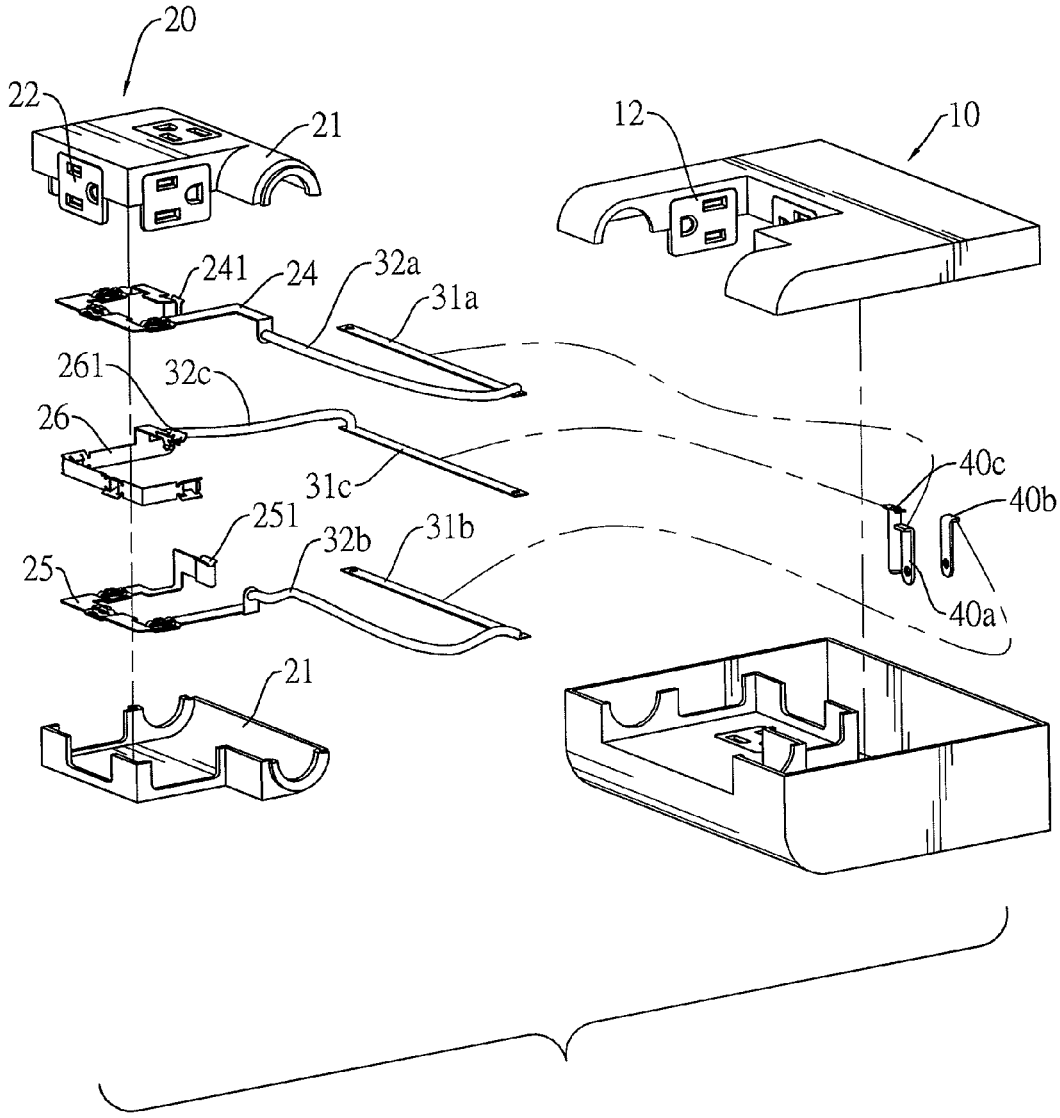
FIG. 13 is a perspectively exploded view of a seventh embodiment of a power receptacle device in accordance with the present invention.

With reference to FIGS. 10 to 12, a sixth embodiment of a power strip in accordance with the present invention comprises a stationary base (10) and four rotating bases (20). The stationary base (10) has a hollow (11) and multiple sockets (12) formed in the hollow (11). The stationary base (10) contains a power cable (30) that conducts electricity. Two of the rotating bases (20) are mounted rotatably in the stationary base (10) at the same side, and the other two rotating bases (20) are mounted rotatably in the stationary base (10) at the other opposite side. Each rotating base (20) has one or more sockets (22). All the sockets (12)(22) in the stationary base (10) and the rotating base (20) correspondingly face each other when the rotating base (20) is in a closed position as shown in FIG. 12. When the rotating base (20) is turned out from the stationary base (10), the sockets (12)(22) in the stationary base (10) and the rotating base (20) are exposed.

With reference to FIG. 13, the power receptacle device of the seventh embodiment in accordance with the present invention is implemented as a wall outlet and connected mechanically and electrically to electrical outlet. The power receptacle device comprises a stationary base (10) and a rotating base (20) similar to the first embodiment of FIGS. 1 to 3. In comparison to the first embodiment, the cable (30) is replaced with a power plug composed of multiple contact prongs (40*a*)(40*b*)(40*c*) to conduct electricity. The three contact prongs (40*a*)(40*b*)(40*c*) are respectively connected to the conductive plates (31*a*)(31*b*)(31*c*).

For all foregoing embodiments of the power receptacle device implemented either as a power strip or a wall outlet, the sockets formed in the stationary base and the rotating base can be covered when the rotating base is turned to a position to prevent users from touching the sockets and getting electric shock. When a plug with a large power adapter is plugged in one of the sockets, other sockets are still accessible.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A power receptacle device having a rotatable socket comprising:

a stationary base;

an electricity connection assembly mounted through the stationary base; and a rotating base rotatably mounted in the stationary base and having at least one socket, the at least one socket of the rotating base electrically connected to the electricity connection assembly, wherein the at least one socket of the rotating base is covered when the rotating base is rotated to be received in the stationary base and is exposed to be accessible when the rotating base is turned out from the stationary base.

2. The power receptacle device as claimed in claim 1, wherein the power receptacle device further has multiple conductive plates electrically connected to the electricity connection assembly and mounted in the stationary base, and the at least one socket of the rotating base comprises multiple blades electrically connected to the conductive plates in the stationary base via wires.

3. The power receptacle device as claimed in claim 1, wherein the power receptacle further has multiple conductive plates electrically connected to the electricity connection assembly and mounted in the stationary base, and the at least one socket of the rotating base comprises multiple blades pivotally connected to the conductive plates in the stationary base.

4. The power receptacle device as claimed in claim 1, wherein the stationary base further has at least one socket facing toward the at least one socket of the rotating base when the rotating base is rotated to a rest position and received in the stationary base.

5. The power receptacle device as claimed in claim 1, wherein the electricity connection assembly is a power cable.

6. The power receptacle device as claimed in claim 1, wherein the electricity connection assembly is a power plug.

7. A power receptacle device having rotatable sockets comprising:

a stationary base;

an electricity connection assembly mounted through the stationary base; and multiple rotating bases rotatably mounted in the stationary base and each rotating base having at least one socket, the sockets of the rotating bases electrically connected to the electricity connection assembly, wherein the sockets of the rotating bases are covered by other rotating bases when the rotating bases are rotated to an aligned position and are exposed for use when the rotating bases are rotated out of the aligned position.

8. The power receptacle device as claimed in claim 7, wherein the power receptacle device further has multiple conductive plates electrically connected to the electricity connection assembly and mounted in the stationary base, and the at least one socket of each rotating base comprises multiple blades electrically connected to the conductive plates in the stationary base via wires.

9. The power receptacle device as claimed in claim 7, wherein the power receptacle device further has multiple conductive plates electrically connected to the electricity connection assembly and mounted in the stationary base, and the at least one socket of each rotating base comprises multiple blades pivotally connected to the conductive plates in the stationary base.

10. The power receptacle device as claimed in claim 7, wherein the stationary base has one side and the multiple rotating bases are mounted rotatably in the side of the stationary base; and each of the rotating bases has an adjacent surface and the socket is formed on the adjacent surface, wherein the sockets are covered by the rotating bases when the rotating bases are turned to a position where the adjacent surfaces of the rotating bases face each other.

11. The power receptacle device as claimed in claim 7, wherein the stationary base has two opposite sides and the multiple rotating bases are mounted rotatably in the opposite sides of the stationary base; and each of the rotating bases has an overlap surface and the socket is formed on the overlap surface, wherein the sockets are covered by the rotating bases when the rotating bases are turned to overlap each other.

12. The power receptacle device as claimed in claim 7, wherein the stationary base has two opposite sides and the multiple rotating bases are mounted rotatably in the opposite sides of the stationary base; and the sockets of the rotating bases being covered by other rotating bases when the rotating base being rotated to be received in the stationary base, and the sockets being exposed to be accessible when the rotating base being turned out from the stationary base.

13. The power receptacle device as claimed in claim 7, wherein the stationary base has at least two adjacent sides and the multiple rotating bases are mounted rotatably in the at least two adjacent sides of the stationary base; and the sockets of the rotating bases being covered by other rotating bases when the rotating base being rotated to be received in the stationary base, and the sockets being exposed to be accessible when the rotating base being turned out from the stationary base.

14. The power receptacle device as claimed in claim 7, wherein the electricity connection assembly is a power cable.

15. The power receptacle device as claimed in claim 7, wherein the electricity connection assembly is a power plug.

* * * * *